US005244312A

United States Patent [19]

Wybro et al.

[11] Patent Number: 5,244,312

[45] Date of Patent: Sep. 14, 1993

[54] PILE SUPPORTED DRILLING TEMPLATE

[75] Inventors: Pieter G. Wybro, Richmond, Tex.; Fikry Botros, Oslo, Norway

[73] Assignee: Conoco Inc., Ponca City, Okla.

[21] Appl. No.: 810,941

[22] Filed: Dec. 29, 1991

[51] Int. Cl.[5] ..... E02D 21/00; E02D 27/04

[52] U.S. Cl. ..... 405/204; 166/338; 166/366; 405/195.1; 405/229

[58] Field of Search ..... 405/229, 227, 224, 225, 405/203, 204, 205; 166/349, 341, 339, 338, 365, 366

[56] References Cited

U.S. PATENT DOCUMENTS

| | | | |
|---|---|---|---|
| 3,347,053 | 10/1967 | Manning | 405/225 |
| 3,358,752 | 12/1967 | Postlewaite | 166/349 X |
| 3,368,619 | 2/1968 | Postlewaite | 166/349 X |
| 3,493,043 | 2/1970 | Watkins | 166/341 |
| 3,618,661 | 11/1971 | Peterman . | |
| 3,672,177 | 6/1972 | Manning . | |
| 3,716,994 | 2/1973 | Pogonowski | 405/204 |
| 3,881,549 | 5/1975 | Thomas . | |
| 4,212,562 | 7/1980 | Stone et al. | 405/195 |
| 4,426,173 | 1/1984 | Richart et al. | 405/204 X |
| 4,497,592 | 2/1985 | Lawson | 405/202 |
| 4,589,802 | 5/1986 | Hampton | 405/224 X |
| 4,674,920 | 6/1987 | Regan et al. | 405/227 |
| 4,679,964 | 7/1987 | Blandford | 405/216 |
| 4,687,062 | 8/1987 | Beghetto et al. | 166/366 |
| 4,706,757 | 11/1987 | Harrington | 166/349 |
| 4,749,046 | 6/1988 | Gano | 166/366 |
| 4,784,527 | 11/1988 | Hunter et al. | 405/207 |
| 4,784,529 | 11/1988 | Hunter | 405/227 |
| 4,822,212 | 4/1989 | Hall et al. | 405/227 |
| 4,848,474 | 7/1989 | Parizot et al. | 166/366 |

*Primary Examiner*—Dennis L. Taylor

[57] ABSTRACT

A system is provided for installing a drilling template in a level orientation over an ocean floor. The drilling template is supported on a plurality of preset piles. The piles extend above the ocean floor. After the piles are set, their elevations are accurately determined, and pile-receiving sockets in the drilling template are finally fabricated to have depths corresponding to the respective piles to be received therein. Once the drilling template is lowered onto the piles, it is supported in a level orientation.

4 Claims, 5 Drawing Sheets

PILE SUPPORTED DRILLING TEMPLATE

BACKGROUND OF THE INVENTION

1. Field of the Invention

The present invention relates to the construction and installation of a drilling template for use in drilling subsea wells.

2. Description of the Prior Art

Often offshore oil and gas fields are developed by drilling a multitude of wells from a single offshore platform or drilling vessel. The position at which each of the wells penetrate the ocean floor is typically determined through use of a template which is a frame-like structure having a plurality of drilling guide collars, each of which corresponds to a future well location.

It is important that such drilling templates be oriented in a substantially level position. This is often difficult when the surface of the ocean floor itself is sloped.

One solution to the use of drilling templates on a sloped ocean floor is to construct the template so that its bottom surface is sloped similarly to the ocean floor. Such a template is shown for example in U.S. Pat. No. 4,784,527 to Hunter et al. The Hunter et al. template framework is placed on the ocean floor and then anchoring piles are inserted through the template. Subsequently, modular drilling templates are lowered into place within the main framework. The modular drilling templates include the guide collars for actual drilling of wells.

It is also known to place a drilling template on a plurality of preset anchor pilings. The difficulty with these systems is the subsequent leveling of the template upon the pilings. For example, U.S. Pat. No. 4,212,562 to Stone et al. discloses a template which is set in place on a plurality of pilings and then subsequently leveled with a complex hydraulic elevating mechanism. Once appropriately positioned, the template is clamped to the pilings by a hydraulic clamping mechanism. A somewhat similar proposal is seen in U.S. Pat. No. 4,674,920 to Regan et al.

It is also known to set a drilling template on a single wellhead, where the template rests on the upper end of the wellhead. This is shown for example in U.S. Pat. No. 4,706,757 to Harrington. Another similar system is seen in U.S. Pat. No. 4,497,592 to Lawson. These systems which set on a single wellhead or piling typically are relatively small templates.

There is a need for an economical, easily installed system for locating a relatively large drilling template in a level position upon an unlevel ocean floor without the need for complex adjusting mechanisms.

SUMMARY OF THE INVENTION

The present invention provides a system for installing a drilling template in a level position above the ocean floor. The system is particularly suitable for positioning such a drilling template adjacent an existing structure such as one or more existing wellheads located upon the ocean floor.

A spacer frame is provided and is lowered through the body of water to a position on the floor adjacent the existing structure. The spacer frame includes a plurality of pile guides.

Next, a plurality of piles are set into the floor of the body of water, those piles being positioned by the pile guides of the spacer frame. Each of the piles has an upper end which extends a substantial distance on the order of perhaps fifteen to twenty feet above the ocean floor after the pile is in place. These piles will later support the drilling template.

The piles are preferably positioned in a pattern of four, with two of the piles being substantially higher than the other two, for example five feet higher.

After the piles are positioned, they are carefully surveyed to determine the actual relative elevations between the piles. Subsequently, the fabrication of the drilling template is completed. The drilling template includes sockets for receiving the upper ends of the piles and each socket includes a load-bearing member for resting upon the upper end of one of the piles. The load-bearing members are elevationally spaced relative to each other substantially the same as the measured elevations of the respective upper ends of the piles to be received therein.

Subsequently, the drilling template is lowered into place over the piles so that the load-bearing members of the sockets are in load-bearing engagement with the upper ends of the respective piles received therein. The template rests upon the piles in a substantially level position over the floor of the body of water. This is accomplished without the need for any adjusting or clamping mechanisms of any kind.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 1, a spacer frame is being lowered into place on the ocean floor adjacent an existing wellhead structure.

In FIG. 2, the spacer frame is shown in position adjacent the existing structure on the ocean floor.

In FIG. 3, piles have been set through the pile guides of the spacer template.

In FIG. 4, the drilling template is being lowered into place, and has just docked with the taller piles.

In FIG. 5, the drilling template has been lowered completely into place over the piles and is resting in a substantially level position.

FIG. 7 is a plan view of the structure seen in elevation in FIG. 2.

DETAILED DESCRIPTION OF THE PREFERRED EMBODIMENTS

FIGS. 1-5 comprise a sequential series schematic illustrations showing the general method of the present invention.

Figure 1:
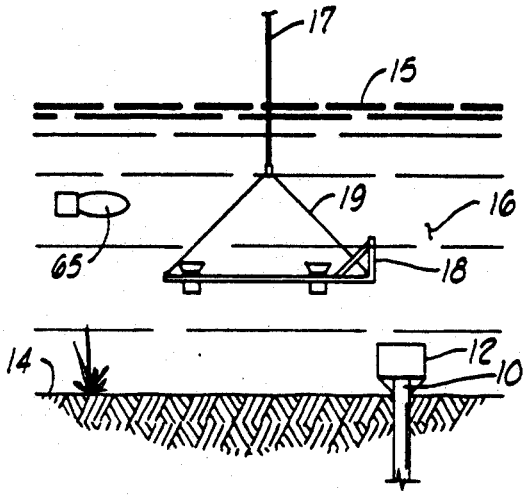
FIGS. 1–5 comprise a sequential series of schematic illustrations showing the methods of installing a drilling template in accordance with the invention.

In FIG. 1, an existing wellhead 10 having a wellhead guide base 12 attached thereto is shown in position on the ocean floor 14. The floor 14 may be generally described as a floor of the body of water 16.

A spacer frame 18 is shown being lowered through the body of water 16 toward the ocean floor 14. The spacer frame 18 may for example be lowered from a semi-submersible drilling vessel (not shown) floating upon the surface 15 of the body of water 18. A drill string 17 lowers the spacer frame 18 downward from the drilling vessel. Slings 19 suspend spacer frame 18 from drill string 17.

The spacer frame may similarly be lowered from a crane vessel, or any other type of vessel.

Figure 2:
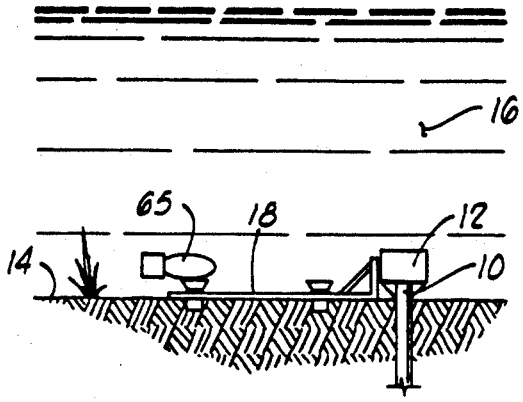

In FIG. 2, the spacer frame 18 has been lowered into place adjacent the guide base 12 of Welhead 10. As best seen in the plan view of FIG. 7, the particular embodiment of the invention illustrated is designed for placement adjacent the first wellhead 10 and a second wellhead 20 having a guide base 22 located thereabout.

Figure 7:
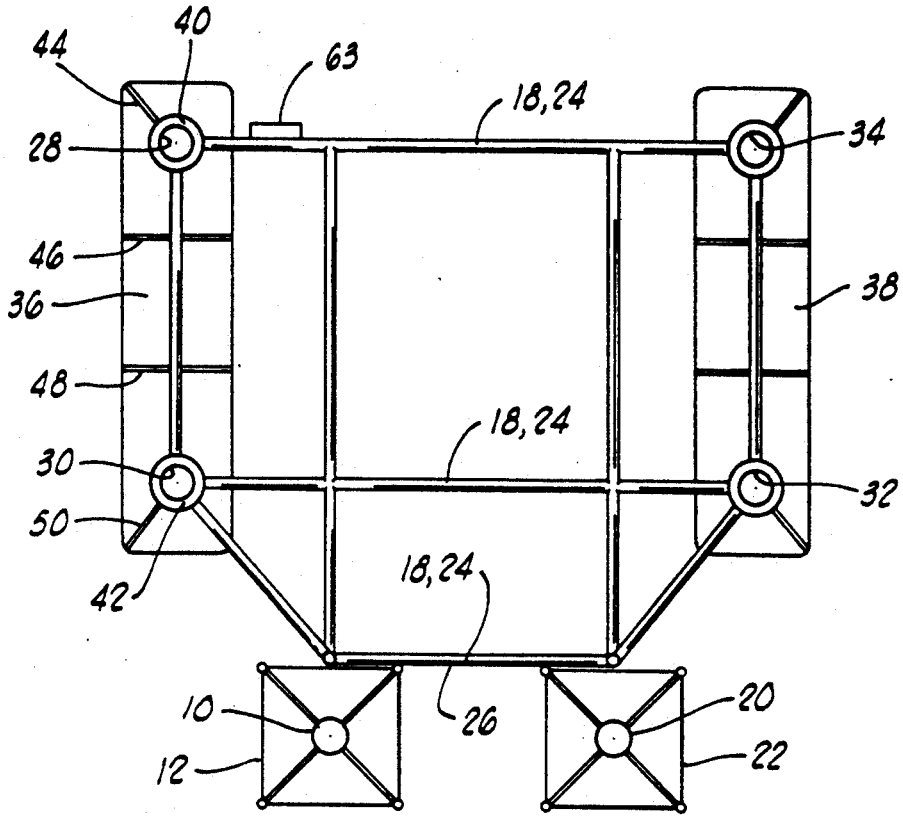
FIG. 7 is a plan view of the spacer frame sitting on the ocean floor adjacent two existing well structures.
Figure 8:
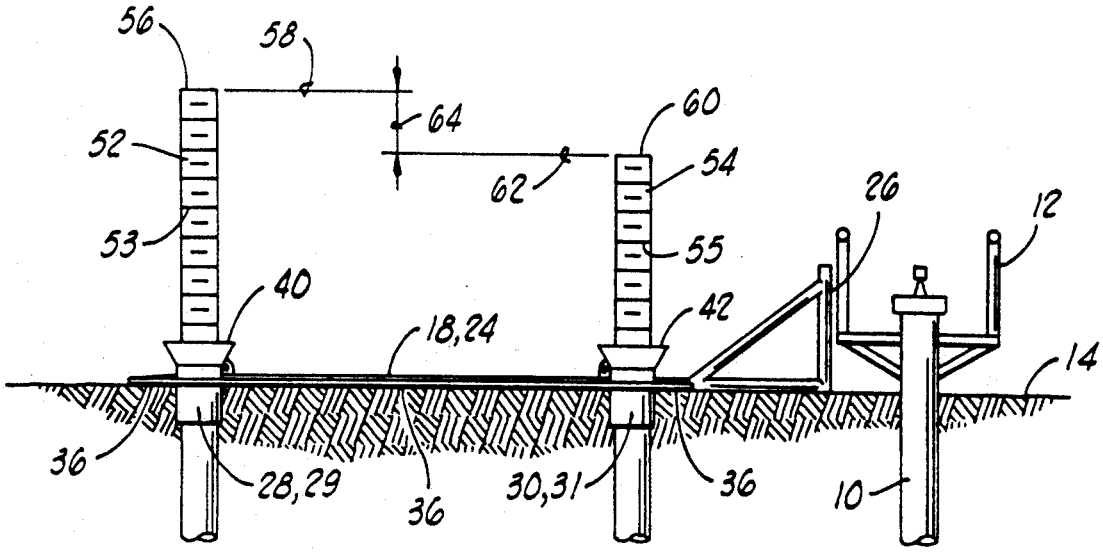
FIG. 8 is an enlarged elevation view similar to FIG. 3 showing in more detail the piles which have been set through the spacer frame structure.

As best seen in FIGS. 7 and 8, the spacer frame 18 includes a fabricated framework 24 having a bumper portion 26 which abuts the guide bases 12 and 22 of wellheads 10 and 20. Spacer frame 18 further includes four cylindrical pile guides 28, 30, 32 and 34 attached to the framework 24.

Plate-like mud mats 36 and 38 are attached to the framework 24 in substantially the same plane as the framework 24 as best seen in FIG. 8. The mud mat 36 may include a plurality of vertical stiffener plates such as 44, 46, 48 and 50. The mud mats 36 and 38 rest on the ocean floor 14.

The upper end of each pile guide 28, 30, 32 and 34 includes a conical shaped guide funnel such as 40 and 42. The lower ends of the pile guides include skirt portions such as 29 and 31 which may extend as much as twenty to thirty inches below the plane of the framework 24 so as to dig into the ocean floor 14 to help prevent the spacer frame 18 from skidding across the ocean floor as it is lowered into place.

A remotely operated vehicle (ROV) 65 may be utilized for observing and for guiding the spacer frame 18 as it is lowered. Once the spacer frame 18 is located upon the ocean floor 14, the ROV 65 will confirm the position of spacer frame 18 and will confirm the frame orientation by docking onto a docking plate 63 provided on the spacer frame 18 and reading the gyrocompass of the ROV 65. The ROV 65 can then be utilized to release the spacer frame 18 from the slings 19 by which it was lowered.

Figure 3:
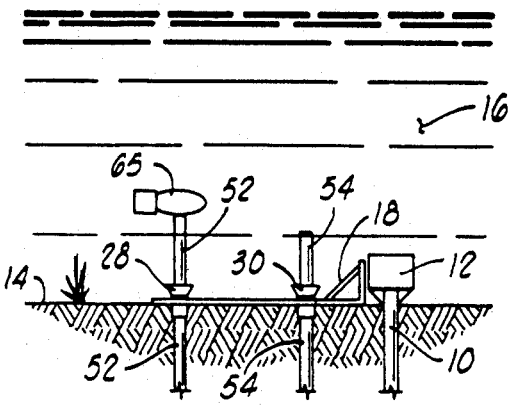

After the spacer frame 18 has been set in place adjacent to the existing wellhead(s), a plurality of piles are set through the pile guides 28, 30, 32 and 34 into the ocean floor 14. In FIG. 3, two such piles designated as 52 and 54 are seen having been placed through pile guides 28 and 30, respectively.

An enlarged view of FIG. 3 is seen in FIG. 8. Preferably, the two piles placed through pile guides 28 and 34 are set so that their upper ends 56 are located at an elevation 58. Only one of those piles, namely pile 52, is visible in FIG. 8. The piles set through pile guides 30 and 32, on the other hand, are set so that upper ends 60 are at an elevation 62 substantially below elevation 58 by a distance indicated at 64. In the preferred embodiments, the distance 64 is approximately five feet so that the upper ends 56 of the piles set through pile guides 28 and 34 are located approximately five feet above the upper ends 60 of the piles set through pile guides 30 and 32. The purpose of this difference in elevation is to make it easier for the drilling template to initially dock with the pile guides by first having it engage only the taller piles and then having it settle into position on the shorter piles.

The pile 52 may for example extend approximately twenty feet above the ocean floor 14 while the pile 54 extends approximately fifteen feet above the ocean floor. As seen in FIG. 8, the piles may have indicia 53 and 55 thereon to help roughly determine the height of the piles.

The piles such as 52 and 54 can be set into the ocean floor using any one of a number of conventional pile driving or drilling techniques. The technique preferred for this application involves the use of a tubular pile through which a drill string can be inserted. As the hole is drilled through the pile, the weight of the pile causes it to sink into the muddy bottom. The piles should be installed within 0.5° of vertical.

The pile guide sleeves 28, 30, 32 and 34 are designed to have ample clearances for the piles 52 and 54. For example, the pile guide sleeves will typically be about three feet long and have a thirty-six-inch OD and be made of relatively thin-walled pipe. The piles 52 and 54 have a nominal outside diameter of thirty inches and thus can very loosely fit through the guide sleeves. This will provide a non-binding fit to the pile with up to about fifteen degrees relative angle.

This non-binding fit between the piles and the pile guide sleeves can accommodate a substantial non-level condition of the ocean floor. If the ocean floor is more steep than can be accommodated by the non-binding fit of the piles within the pile guide sleeves, the spacer frame 18 can be constructed so that the pile guide sleeves are oriented at an angle other than 90° to the plane of the spacer frame.

The piles 52 and 54 will typically be about two hundred feet long and will be made up by joining forty-foot sections with flush OD mechanical connectors. Alternatively, the piles can be single piece without mechanical connectors.

The actual relative elevation of the pile heads may be determined to within plus or minus 1.5 inches of each other by the ROV 65 with a manipulator held high accuracy depth transducer (such as a digital-quartz transducer available from Paroscientific of Seattle, Wash.). The pile positions may be also surveyed by the ROV 65 through the use of accurate high resolution sonar fitted into the ROV 65. The ROV 65 is docked at various prescribed points on the individual wellheads 10 and 20 to get pile positions relative to the wells, and is then docked on the piles as illustrated in FIG. 3 to confirm that position.

Figure 4:
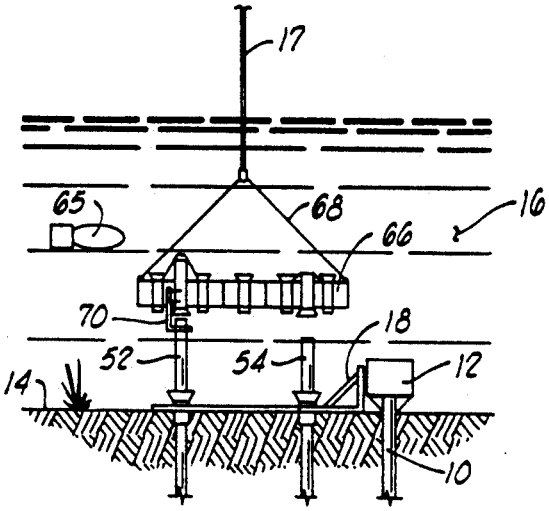
Figure 9:
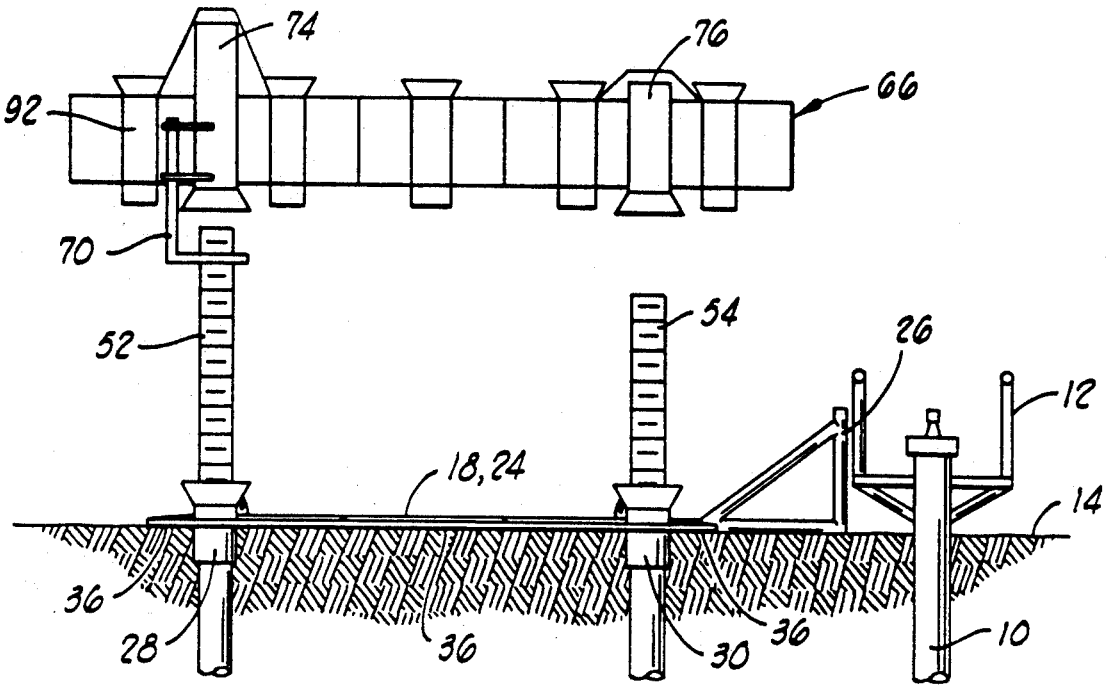
FIG. 9 is an enlarged elevation view similar to FIG. 4 showing in more detail the docking of the drilling template with the taller piles.

After the accurate determination of the relative elevations of the upper ends of the piles, the final fabrication of the drilling template will be completed. The drilling template is schematically shown in FIG. 4 and indicated by the numeral 66. The drilling template is lowered into place with sling 68. In FIGS. 4 and 9, a docking means 70 has just engaged the upper portions of the taller piles such as 52.

Figure 6:
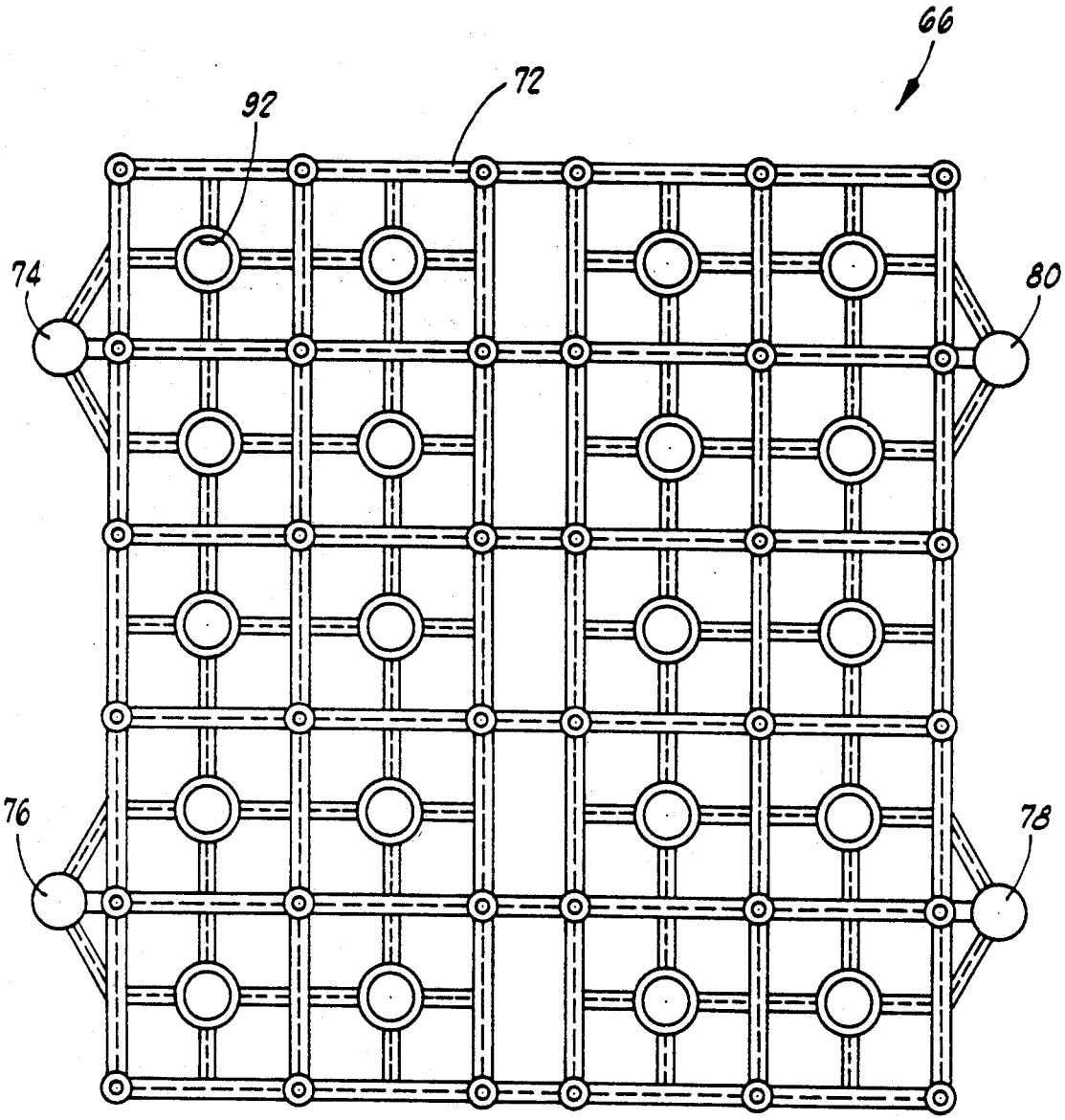
FIG. 6 shows a plan view of the drilling template.

A plan view of the drilling template 66 is shown in FIG. 6. The drilling template 66 includes a template frame 72 having at least three sockets, and preferably four sockets 74, 76, 78 and 80 attached to the frame 72 for receiving the upper ends such as 56 and 60 of the piles such as 52 and 54. The frame 72 is generally rectangular in shape. The sockets are preferably located laterally outward from the opposed sides of the rectangular frame as seen in FIG. 6. The template 66 can use a simple ballasting/flooding system (not shown) to control buoyancy during installation.

Figure 13:
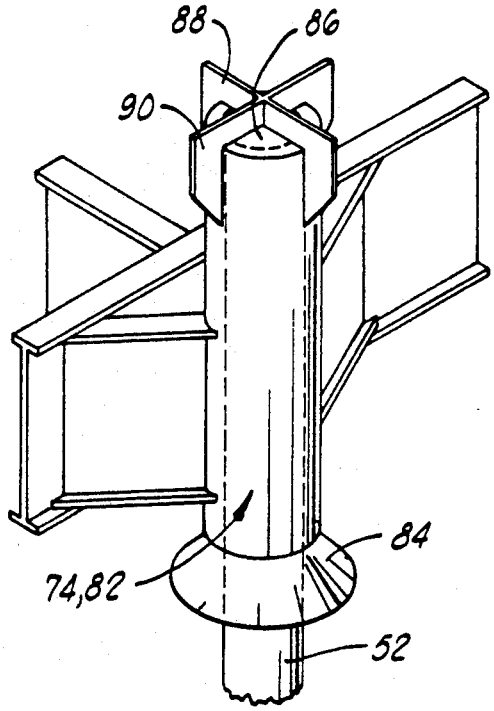
FIG. 13 is an enlarged perspective view showing the details of construction of one of the socket means of the drilling template.

FIG. 13 shows an enlarged, more detailed view of the socket 74.

The socket 74 has a cylindrical outer wall 82 with a nominal diameter of thirty-six inches for loosely receiving the thirty-inch nominal diameter pile therein. This provides lateral tolerance in placement of the drilling template over the piles. The tolerances for the lateral positioning of the piles is much less restricted than with many prior art systems since the piles are not to be engaged by complex close tolerance mechanical gripping and adjusting assemblies. A downwardly open guide funnel 84 is provided for guiding the pile 52 into place. A flat plate 86 closes the upper end of cylindrical wall 82 and may be generally referred to as a load-bearing means 86 for landing in free load-bearing engagement with the upper end 56 of pile 52. Reinforcing plates 88 and 90 span end plate 86.

It is only after the final elevations of the upper ends such as 56 and 60 of the piles such as 52 and 54 have been surveyed through the use of the ROV 65, that the upper end plates 86 of cylindrical wall 82 will be finally positioned and welded in place.

The drilling template 66 will be finally fabricated so that the upper ends of sockets 74, 76, 78 and 80 have relative elevations corresponding to the relative elevations of the upper ends of the piles to be received therein. Thus, if one or more of the piles is determined to be initially positioned a bit higher or lower than planned, this can be accommodated by making the socket which will receive that pile longer or shorter as the case may be.

As is seen in FIG. 6, the drilling template 66 will have a plurality of drilling guide sleeves such as 92 fixed within the framework 72. The drilling template 66 seen in FIG. 6 includes twenty such drilling guide sleeves.

Figure 11:
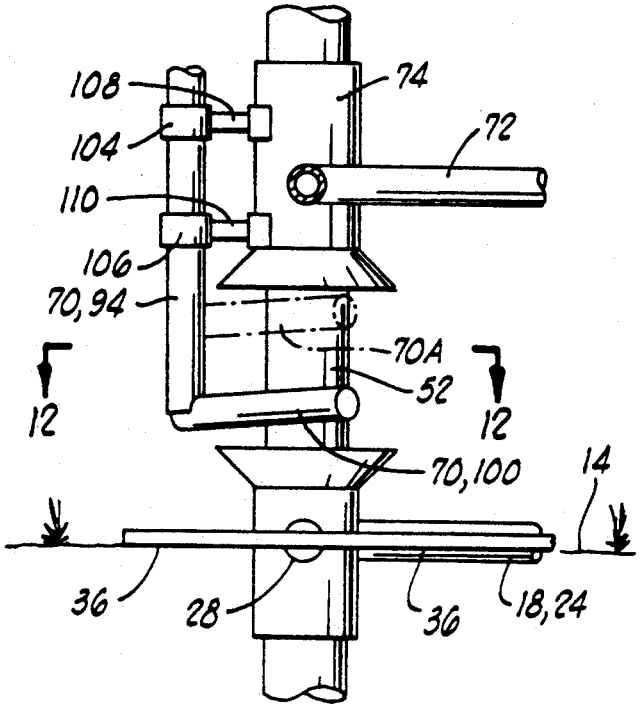
FIG. 11 is an enlarged partial view of the lower left corner portion of FIG. 10 showing more details of the docking means.

The docking means 70 is best seen in the enlarged view of FIG. 11. Preferably there are two such docking means 70, one associated with socket 74 and the other associated with socket 80. The two docking means 70 will engage the upper end portions of the taller piles received through pile guides 28 and 34.

Figure 12:
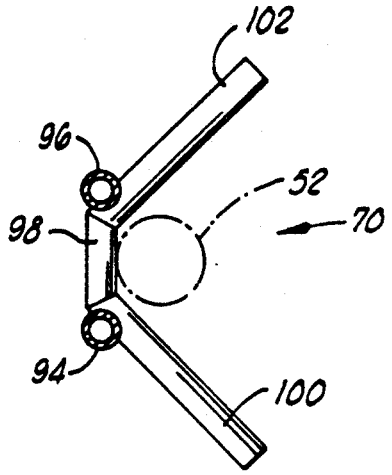
FIG. 12 is a plan view taken along line 12—12 of FIG. 11 showing only the structure of the cow-catcher type docking mechanism.

The docking means 70 includes two vertical pipe shafts 94 and 96 as seen in FIG. 12. The vertical shafts 94 and 96 are joined by a crosspiece 98. Cow-catcher arms 100 and 102 extend from the shafts 94 and 96, all as shown in FIG. 12.

The docking means 70 are constructed so that if they are inadvertently engaged with the piles with too heavy a force, the cow-catcher arms 100 and 102 will break away before the piles themselves will be damaged.

The vertical shafts 94 and 96 are received within shaft guides such as guides 104 and 106 receiving shaft 94 as seen in FIG. 11. The shaft guides are attached to the socket 74 by supporting arms 108 and 110. The shafts 94 and 96 can slide vertically within guides 104 and 106 so that the docking means 70 can slide up to a position as shown in phantom lines in FIG. 11 and designated by the numeral 70A for storage prior to placement of the drilling template 66 in the body of water. Thus the docking means 70 can be described as being vertically extendable and retractable relative to the frame 72.

When the drilling template 66 is being lowered into place as shown in FIGS. 4 and 9, it will be done under the observation of the ROV 65. The template 66 will be maneuvered until the taller piles such as 52 are received between the arms 100 and 102 of the docking means 70 with the pile abutting the crosspiece 98. In FIG. 12, the position of pile 52 after docking is shown in phantom lines.

Figure 5:
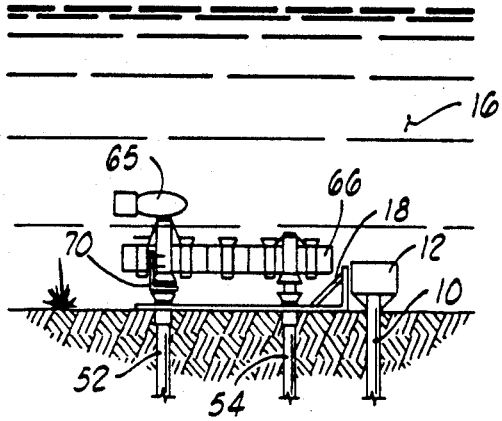
Figure 10:
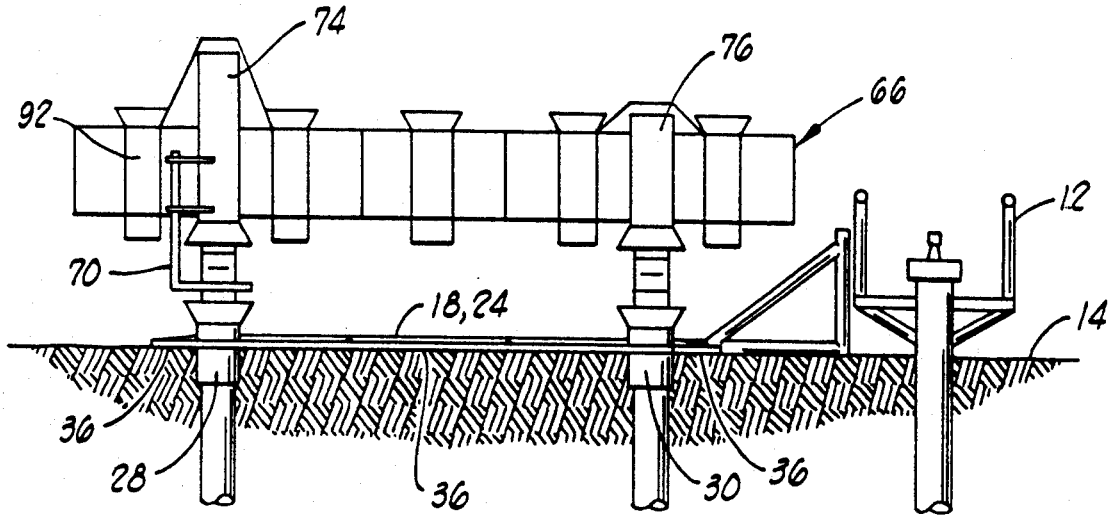
FIG. 10 is an enlarged elevation view similar to FIG. 5 showing the drilling template resting in its final position upon the piles.

With the taller piles so positioned within the docking means 70, the drilling template 66 can be further lowered from the position shown in FIG. 9 to the position of FIGS. 5 and 10. As the drilling template 66 is lowered, the guide funnels such as 84 will guide the upper ends of the piles into their respective sockets.

The docking procedure proceeds by first positioning the template 66 approximately twenty feet laterally from the target piles. Template orientation is then adjusted and the depth is lowered to docking depth as confirmed by the ROV 65 high accuracy depth transducer. The template 66 is then docked as illustrated in FIG. 9 by prescribed incremental moves of the semi-submersible drilling rig on its anchors along the docking path with position and depth monitored and checked both by ROV 65 and subsea acoustical array during the docking procedure. The docking piles such as 52 will be engaged by slowly moving horizontally and capturing the piles between the arms 100 and 102 as illustrated in FIG. 12. After both of the taller piles have been engaged by the docking means 70, the drilling template 66 is lowered slowly so that the taller piles are received in the sockets 74 and 80. The template 66 then continues to be lowered until the shorter piles are received within sockets 76 and 78. The template 66 is finally lowered until the support plates such as 86 of the sockets rest upon the upper ends of the piles. The template 66 will land out level and will not need to be mechanically locked to the piles.

The drilling template 66 will ultimately rest in a position as shown in FIG. 10 wherein the bearing plates such as 86 of the sockets will rest in free load-bearing engagement upon the upper ends of the piles. If the elevations of the pile ends have been accurately surveyed, and the drilling template 66 has been accurately fabricated, the drilling template 66 will come to rest in a substantially level position.

As is apparent in FIGS. 9 and 10, the spacer frame 18 is left in place on the ocean floor when the template 66 is lowered into position. Since there is no interference between the spacer frame 18 and the drilling template 66, there is no need to remove the spacer frame 18 after the piles are set in place.

When the drilling template 66 is finally positioned as illustrated in FIG. 10, it remains above the ocean floor 14 without engaging the ocean floor 14. Thus, the level orientation of the drilling template 66 is not affected by any unlevel surface feature of the ocean floor 14.

In spite of the care which is taken to initially determine the elevations of the upper ends of the piles, and to finally fabricate the drilling template 66 so that its sockets will correspond to those piles, the level orientation of the drilling template 66 should be checked after it has been lowered into place as shown in FIG. 10. This can again be accomplished by docking the ROV 65 with the drilling template 66 as schematically illustrated in FIG. 5.

After template landing, the level is determined by a crosscheck of one or both of two methods. An ROV held inclinometer may be placed on level pads located on the four template sides. An accurate depth determination by ROV held depth sensor placed adjacent each of the four template sides may also be used.

If it is determined that the drilling template 66 is not sufficiently level, this can be corrected by lifting the drilling template 66 off the piles and then increasing the elevation of one or more of the upper ends of the piles so as to correct for any unlevel condition.

Figure 14:
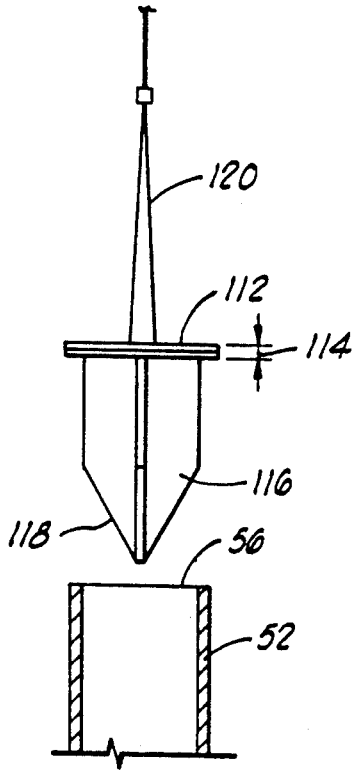
FIG. 14 illustrates an apparatus and method for adjusting the height of one of the piles after the pile is set in place.

This is accomplished as illustrated in FIG. 14. For example, if it is determined that the pile 52 has its upper end 56 slightly lower than desired, an end spacer plate 112 is constructed having a thickness 114 equal to the amount by which it is desired to raise the height of pile 52. The end spacer plate 112 is constructed to set upon the upper end 56 of pile 52. Four centralizing plates 116 extend downward from spacer plate 112 and are tapered at their lower ends as indicated at 118. The spacer plate assembly 112 is then lowered with a sling 120 into the open upper end 56 of pile 52 until the spacer plate 112 rests upon the upper end 56 thus effectively raising the height of pile 52 by the thickness 114 of spacer plates 112.

Then, the drilling template 66 is again lowered into place as illustrated in FIGS. 9 and 10. The sling 68 can then be released by the ROV 65.

The template 66 does not need any leveling or mechanical gripping systems since it simply rests upon the four preset piles.

Such a drilling template may for example be used with a tension leg platform. In such a situation a foundation template for the tension leg platform will subsequently be positioned around the drilling template and anchored into the ocean floor 14 in a known manner. A guide frame (not shown) may be attached to the drilling template 66 for positioning of docking piles to be used to subsequently position the foundation template which will then be anchored to the ocean floor for subsequently supporting the tension leg platform.

Thus it is seen that the apparatus and methods of the present invention readily achieve the ends and advantages mentioned as well as those inherent therein. While certain preferred embodiments of the invention have been illustrated and described for the purposes of the present disclosure, numerous changes may be made by those skilled in the art, which changes are encompassed within the scope and spirit of the appended claims.

What is claimed is:

1. A method of installing a subsurface template in a substantially level position above a floor of a body of water, comprising:

(a) setting a plurality of piles into said floor, each of said piles having an upper end and thereupon determining said elevations of said upper ends of said piles by measuring said elevations after said piles are finally set in said floor;

(b) providing a template having a plurality of sockets for receiving said upper ends of said piles, said sockets each including a load-bearing member, said load-bearing members being elevationally spaced relative to each other substantially the same as the elevations of the respective upper ends of the piles to be received therein, thereupon completing fabrication of said template to position said load-bearing members thereon after measuring of said elevations;

(c) lowering said template into place over said plurality of piles so that said load-bearing members of said sockets are in load-bearing engagement with said upper ends of the respective piles received therein so that said template rests on said piles in a substantially level position over the floor of the body of water.

2. The method of claim 1, being further characterized as a method of installing said template adjacent an existing structure on said floor, further comprising:

prior to step (a), lowering a spacer frame through said body of water to a position on said floor adjacent said existing structure, said spacer frame including a plurality of pile guides; and step (a) further includes setting said plurality of piles through said pile guides into said floor.

3. A method of installing a subsurface template in a substantially level position above a floor of a body of water, comprising:

(a) setting a plurality of piles into said floor, each of said piles having an upper end;

(b) providing a template having a plurality of sockets for receiving said upper ends of said piles, said sockets each including a load-bearing member, said load-bearing members being elevationally spaced relative to each other substantially the same as the elevations of the respective upper ends of the piles to be received therein;

(c) lowering said template into place over said plurality of piles so that said load-bearing members of said sockets are in load-bearing engagement with said upper ends of the respective piles received therein so that said template rests on said piles in a substantially level position over the floor of the body of water; further comprising:

checking said template for a level orientation after step (c); and if said template is not sufficiently level: removing said template; increasing an elevation of said upper end of at least one of said piles; and replacing said template on said piles.

4. The method of claim 3, being further characterized as a method of installing said template adjacent an existing structure on said floor, further comprising:

prior to step (a), lowering a spacer frame through said body of water to a position on said floor adjacent said existing structure, said spacer frame including a plurality of pile guides; and step (a) further includes setting said plurality of piles through said pile guides into said floor.

* * * * *